US007408431B2

(12) United States Patent
Kim et al.

(10) Patent No.: US 7,408,431 B2
(45) Date of Patent: Aug. 5, 2008

(54) MINIATURIZED PARALLEL COUPLED LINE FILTER USING LUMPED CAPACITORS AND GROUNDING AND FABRICATION METHOD THEREOF

(75) Inventors: Young-hwan Kim, Taean-eup (KR); Mi-hyun Son, Seoul (KR); Seong-sik Myoung, Goyang-si (KR); Jong-gwan Yook, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 279 days.

(21) Appl. No.: 11/227,236

(22) Filed: Sep. 16, 2005

(65) Prior Publication Data

US 2006/0192638 A1 Aug. 31, 2006

(30) Foreign Application Priority Data

Feb. 25, 2005 (KR) ..... 10-2005-0016069

(51) Int. Cl.
*H01P 1/203* (2006.01)

(52) U.S. Cl. ..... 333/204

(58) Field of Classification Search ..... 333/203–205, 333/116

See application file for complete search history.

(56) References Cited

U.S. PATENT DOCUMENTS

| | | | | |
|---|---|---|---|---|
| 4,578,656 | A * | 3/1986 | Lacour et al. | 333/204 |
| 4,757,287 | A * | 7/1988 | Grandfield et al. | 333/205 |
| 4,799,034 | A * | 1/1989 | Silverman et al. | 333/202 |
| 5,136,269 | A * | 8/1992 | Seitzer et al. | 333/204 |
| 6,825,738 | B2 * | 11/2004 | Shumovich | 333/112 |

FOREIGN PATENT DOCUMENTS

GB 2246670 A * 2/1992

OTHER PUBLICATIONS

Myoung et al., "Miniaturisation and harmonic suppression method of parallel coupled-line filters using lumped capacitors and grounding", Electronics Letters vol. 41, No. 15, Jul. 21, 2005, pp. 1-2.*

* cited by examiner

*Primary Examiner*—Seungsook Ham
(74) *Attorney, Agent, or Firm*—Sughrue Mion, PLLC

(57) ABSTRACT

A parallel coupled line filter is miniaturized by using lumped capacitors and grounding the capacitors. The parallel coupled line filter includes a parallel coupled line, a first capacitor connected to one of two input ports of the parallel coupled line, and a second capacitor connected to one of two output ports of the parallel coupled line. The parallel coupled filter can be miniaturized to a desirable size, on the basis of relatively simple theoretical knowledge. The parallel coupled line filter exhibits excellent frequency selectivity and improved harmonic characteristics.

12 Claims, 20 Drawing Sheets

EVEN-MODE EQUIVALENT CIRCUIT MODEL

ODD-MODE EQUIVALENT CIRCUIT MODEL

EVEN-MODE EQUIVALENT CIRCUIT MODEL

ODD-MODE EQUIVALENT CIRCUIT MODEL

PARALLEL COUPLED LINE WITH AN OPEN END

PARALLEL COUPLED LINE WITH A GROUNDED END

FILTER WITH OPEN END

FILTER WITH SHORT END

MINIATURIZED FILTER

MINIATURIZED PARALLEL COUPLED LINE FILTER USING LUMPED CAPACITORS AND GROUNDING AND FABRICATION METHOD THEREOF

CROSS-REFERENCE TO RELATED APPLICATIONS

This application claims priority from Korean Patent Application No. 2005-16069, filed on Feb. 25, 2005, the entire content of which is incorporated herein by reference.

BACKGROUND OF THE INVENTION

1. Field of the Invention

The present invention relates in general to a parallel coupled line filter and a fabrication method thereof, and more specifically, to a miniaturized parallel coupled line filter and a fabrication method thereof.

2. Description of the Related Art

In recent years, demands on information technology and radio communication have been rapidly growing. To meet such demands, high performance radio communication equipment has been developed. Currently, however, developing miniaturized radio communication equipment which may be conveniently carried has become a major issue. As part of the ongoing development of miniaturized radio communication equipment, a lot of attention has been drawn to a filter, which is a key component of the radio communication equipment.

Since micro strip filters and Co-Planar Waveguides (CPWs) using planar transmission lines have simple structures and are easy to fabricate, they have been preferably used in radio communication equipment. Naturally, many efforts were made towards the miniaturization of these filters. Some examples of miniaturized filters are as follows.

FIG. 1 shows a miniaturized ladder filter using a slow-wave structure. Because the ladder filter in FIG. 1 has a very complicated structure, it requires a full-wave electro-magnetic (EM) simulation and has structural limitations in miniaturized design.

FIG. 2 shows another example of a miniaturized combine filter using a lumped element. The combine filter in FIG. 2 is miniaturized using a self capacitor and a mutual capacitor. Unfortunately however, extremely complicated calculation in the self capacitor and the mutual capacitor makes it more difficult to design the filter. Further, lack of accurate analysis of the combine structure adds to the difficulty of designing the filter.

FIG. 3 illustrates a hairpin filter. The hairpin filter is miniaturized by bending transmission lines. However, transmission lines can be bent only to a certain extent, so there are limitations in the fabrication of miniaturized hairpin filters.

Therefore, there is a need to develop a filter that can be miniaturized without any limitations and designed on the basis of relatively simple theoretical knowledge.

Aside from the structural limitations as aforementioned, related art filters exhibit very poor harmonic characteristics and skirt characteristics on the high frequency side are not very sharp. Accordingly, it is required to develop a scheme for miniaturizing filters and improving harmonic characteristics and skirt characteristics of the filters at the same time.

SUMMARY OF THE INVENTION

The present invention provides a miniaturized parallel coupled line filter featuring improved filtering characteristics with use of lumped capacitors and grounding.

According to an aspect of the present invention, there is provided a parallel coupled line filter, including: a parallel coupled line; a first capacitor connected to one of two input ports of the parallel coupled line; and a second capacitor connected to one of two output ports of the parallel coupled line.

At least one of the other input port and the other output port may be grounded.

The filter further may include: a third capacitor connected between two input ports of the parallel coupled line; and a fourth capacitor connected between two output ports of the parallel coupled line.

The filter may further include: a third capacitor connected between two input ports of the parallel coupled line; a fourth capacitor connected between two output ports of the parallel coupled line; a fifth capacitor connected to the other input port; and a sixth capacitor connected to the other output port.

The parallel coupled line may be comprised of a parallel coupled line of a second predetermined length that is shorter than the first predetermined length; and capacitances of the first and second capacitors may be determined based on an even-mode characteristic impedance and an odd-mode characteristic impedance of the parallel coupled line of the first predetermined length and on the second predetermined length, respectively.

The even-mode characteristic impedance of the parallel coupled line may be determined based on the even-mode characteristic impedance of the parallel coupled line of the first predetermined length and on the second predetermined length; and the odd-mode characteristic impedance of the parallel coupled line may be determined based on the odd-mode characteristic impedance of the parallel coupled line of the first predetermined length and on the second length, respectively.

According to another aspect of the present invention, there is provided a fabrication method of a parallel coupled line filter, where the method includes: providing a parallel coupled line; connecting a first capacitor to one of two input ports provided to the parallel coupled line; and connecting a second capacitor to one of two output port provided to the parallel coupled line.

The method may further include: grounding at least one of the other input port and the other output port is grounded.

The method may further include: connecting a third capacitor between two input ports of the parallel coupled line; and connecting a fourth capacitor between two output ports of the parallel coupled line.

The method may further include: connecting a third capacitor between two input ports of the parallel coupled line; connecting a fourth capacitor between two output ports of the parallel coupled line; connecting a fifth capacitor to the other input port; and connecting a sixth capacitor to the other output port.

The parallel coupled line may be comprised of a parallel coupled line of a second predetermined length that is shorter than the first predetermined length; and capacitances of the first and second capacitors may be determined based on an even-mode characteristic impedance and an odd-mode characteristic impedance of the parallel coupled line of the first predetermined length and on the second predetermined length, respectively.

The even-mode characteristic impedance of the parallel coupled line may be determined based on the even-mode characteristic impedance of the parallel coupled line of the first predetermined length and on the second predetermined length; and the odd-mode characteristic impedance of the parallel coupled line may be determined based on the odd-mode characteristic impedance of the parallel coupled line of the first predetermined length and on the second length, respectively.

According to another aspect of the present invention, there is provided a parallel coupled line filter which includes: a transmission line; and a capacitor connected between both ends of the transmission line.

The capacitor may be connected to the middle of the transmission line.

At least one of the both ends of the transmission line may be grounded.

The filter may further include: an input line having one end connected to a predetermined capacitor and the other end being grounded; and an output line having one end being grounded and the other end being connected to a predetermined capacitor.

The transmission line may be bent in a hairpin shape.

According to another aspect of the present invention, there is provided a fabrication method of a parallel coupled line filter which includes: providing a transmission line; and connecting a capacitor between both ends of the transmission line.

The capacitor may be connected to the middle of the transmission line.

The method may further include: grounding at least one of the ends of the transmission line.

The method may further include: providing an input line having one end being connected to a predetermined capacitor and the other end being grounded; and providing an output line having one end being grounded and the other end being connected to a predetermined capacitor.

The transmission line may be bent into a hairpin shape.

BRIEF DESCRIPTION OF THE DRAWINGS

The above and/or other aspects of the present invention will be more apparent by describing certain exemplary embodiments of the present invention with reference to the accompanying drawings, in which.

DETAILED DESCRIPTION OF THE EXEMPLARY EMBODIMENTS

Exemplary embodiments of the present invention will be described herein below with reference to the accompanying drawings.

Figure 1:
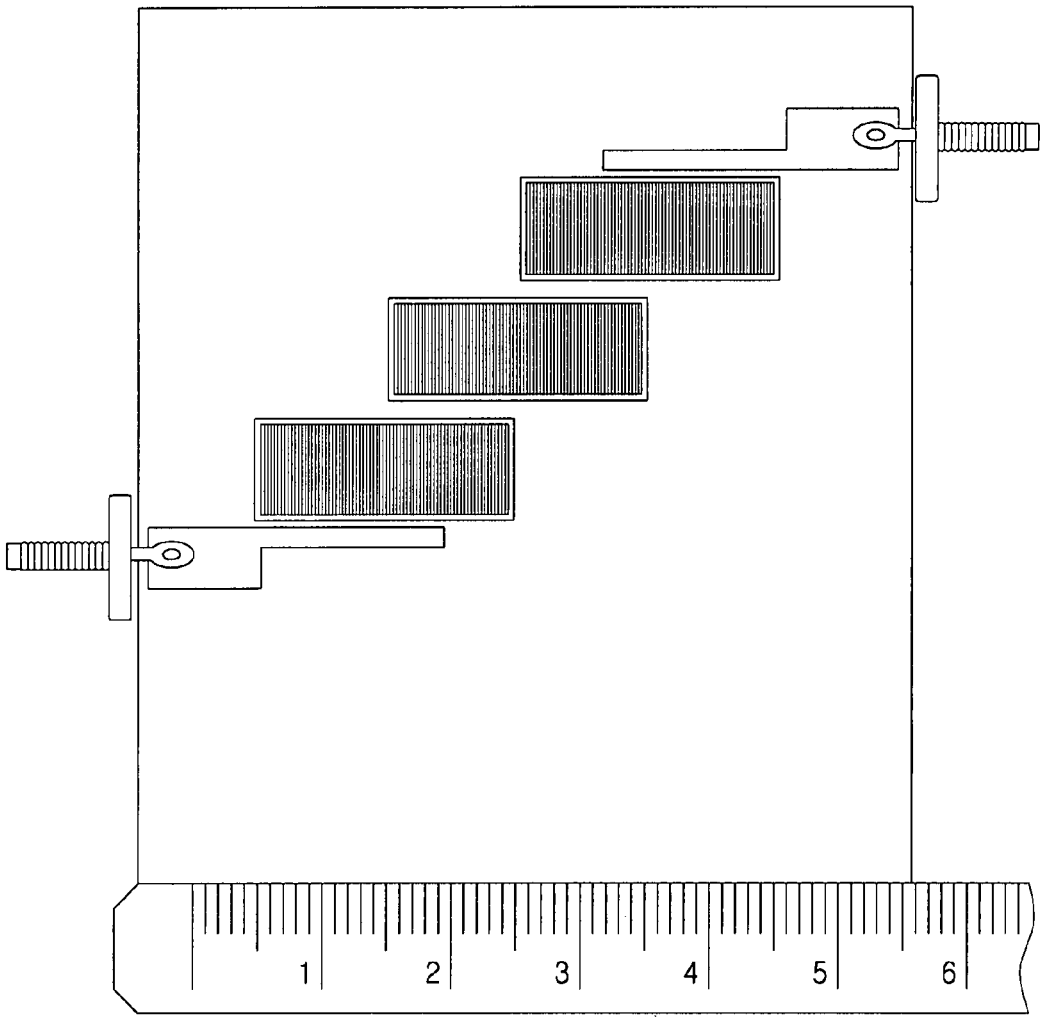
FIG. 1 (PRIOR ART)
FIG. 1 illustrates a related art ladder filter.
Figure 2:
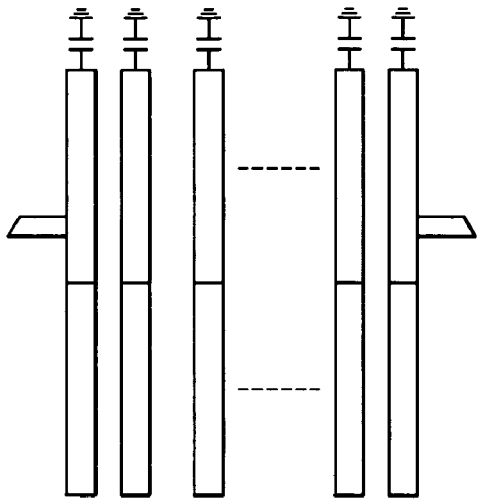
FIG. 2 (PRIOR ART)
FIG. 2 illustrates a related art combine filter.
Figure 3:
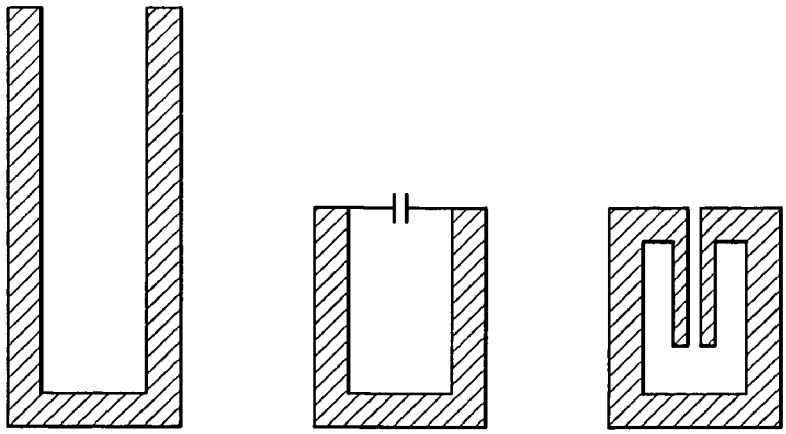
FIG. 3 (PRIOR ART)
FIG. 3 illustrates a related art hairpin filter.
Figure 4:
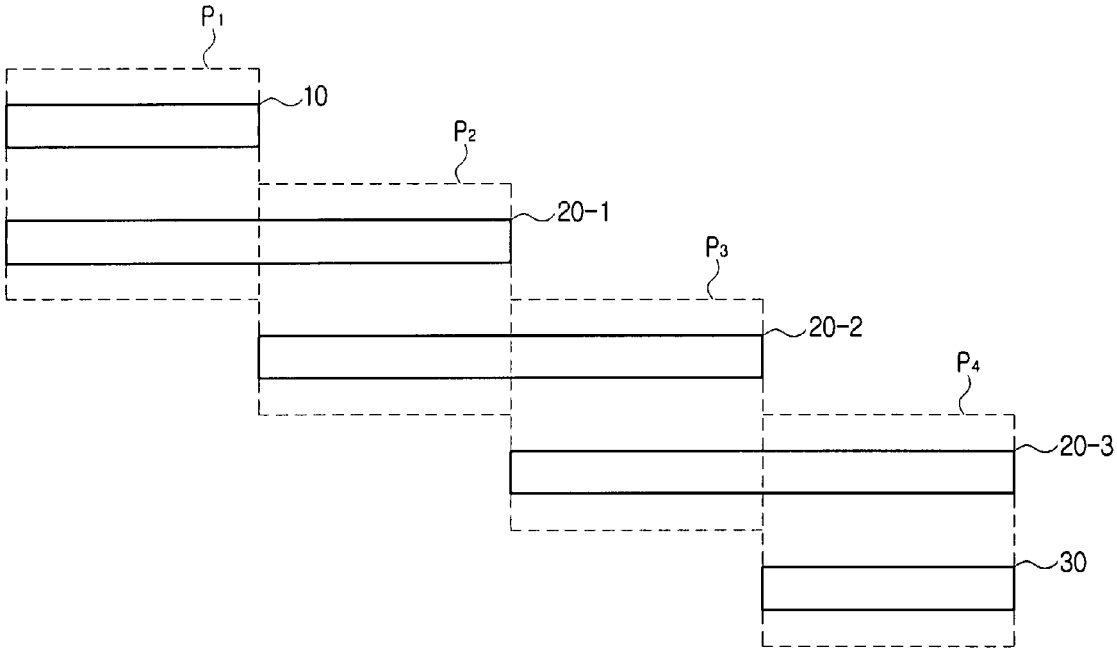
FIG. 4 (PRIOR ART)
FIG. 4 illustrates a typical parallel coupled line filter.

FIG. 4 illustrates a typical parallel coupled line filter. In particular, FIG. 4 shows a $3^{rd}$ order parallel coupled line filter, which includes an input line 10, an output line 30, and three transmission lines 20-1, 20-2, 20-3 between the input line 10 and the output line 30.

An N-th order parallel coupled line filter is composed of (N+1) parallel coupled lines. For instance, the $3^{rd}$ order parallel coupled line filter shown in FIG. 4 has four parallel coupled lines $P_1$, $P_2$, $P_3$ and $P_4$.

In FIG. 4, the assumed lengths of the transmission lines 20-1, 20-2, 20-3 are 180° (=λ/2), respectively, and the assumed lengths of the input line 10 and the output line 30 are 90° (=λ/4), respectively. Particularly, the parallel coupled line $P_2$ of FIG. 4 is depicted in FIG. 5A.

Figure 5A:
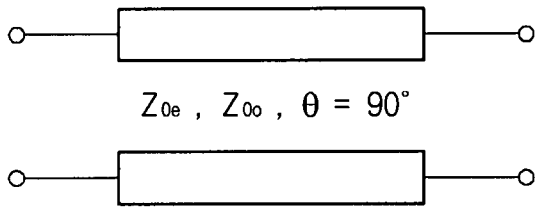
FIG. 5A (PRIOR ART)
FIG. 5A illustrates a parallel coupled line $P_2$ of the parallel coupled line filter of FIG. 4.
Figure 5B:
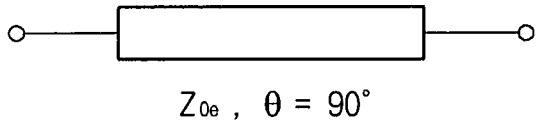
FIG. 5B (PRIOR ART)
FIG. 5B illustrates an even mode equivalent circuit model of a parallel coupled line in FIG. 5A.
Figure 5C:
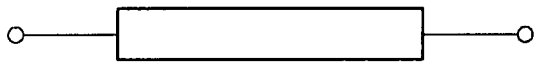
FIG. 5C (PRIOR ART)
FIG. 5C illustrates an odd mode equivalent circuit model of a parallel coupled line in FIG. 5A.

The length θ of the parallel coupled line in FIG. 5A is 90° (=λ/4). Also, an even-mode characteristic impedance of the parallel coupled line in FIG. 5A is $Z_{0e}$, and an odd-mode characteristic impedance thereof is $Z_{0o}$. FIG. 5B illustrates an even mode equivalent circuit model of the parallel coupled line in FIG. 5A, and FIG. 5C illustrates an odd mode equivalent circuit model of the parallel coupled line in FIG. 5A.

Figure 6A:
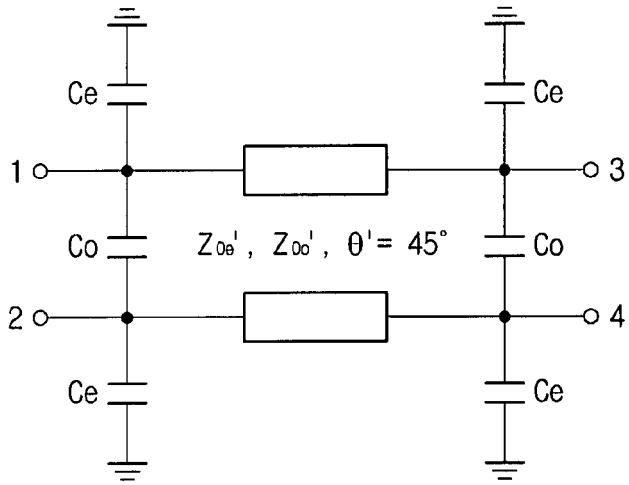
FIG. 6A illustrates a miniaturized parallel coupled line using capacitors.

FIG. 6A illustrates a miniaturized parallel coupled line having an upper input port 1, a lower input port 2, an upper output port 3, and a lower output port 4, and using capacitors $C_e$ and $C_0$. The parallel coupled line in FIG. 6A is equivalent to the parallel coupled line in FIG. 5A. The assumed even-mode characteristic impedance of the parallel coupled line in FIG. 6A is $Z_{0e}'$, and the assumed odd-mode characteristic impedance thereof is $Z_{0o}'$. Further, the length θ' of the parallel coupled line in FIG. 6A is assumed to be half of the length θ of the parallel coupled line in FIG. 5A, i.e., 45° (=λ/8).

In effect, the length θ' of the parallel coupled line in FIG. 6A is assumed to be half of the length θ of the parallel coupled line in FIG. 5A, mainly for the sake of convenience. However, whenever necessary, the length θ' of the parallel coupled line in FIG. 6A can be set to a different value.

Figure 6B:
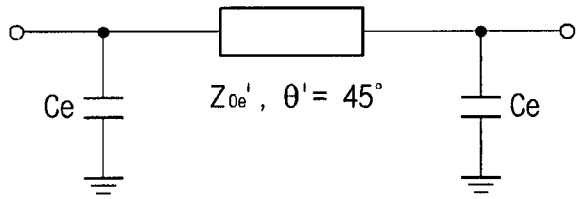
FIG. 6B illustrates an even mode equivalent circuit model of a parallel coupled line in FIG. 6A.
Figure 6C:
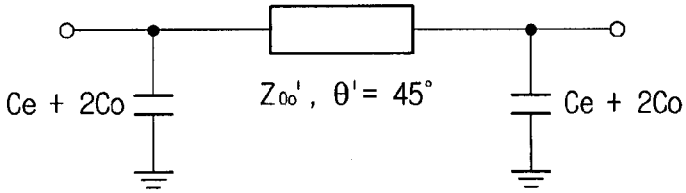
FIG. 6C illustrates an odd mode equivalent circuit model of a parallel coupled line in FIG. 6A.

FIG. 6B illustrates an even mode equivalent circuit model of the parallel coupled line in FIG. 6A, and FIG. 6C illustrates an odd mode equivalent circuit model of the parallel coupled line in FIG. 6A. The parallel coupled line in FIG. 6A is equivalent to the parallel coupled line in FIG. 5A. Accordingly, (i) an even mode equivalent circuit model in FIG. 6B is equivalent to that of FIG. 5B, and (ii) an odd mode equivalent circuit mode in FIG. 6C is equivalent to that of FIG. 5C, respectively.

Based on the equivalence relation of (i) and (ii), $Z_{0e}'$, $Z_{0o}'$, $C_e$ and $C_o$ can be expressed by $Z_{0e}$, $Z_{0o}$, and θ' as follows in Equations (1) through (4), respectively:

$$Z_{0e}'=Z_{0e}/\sin\theta' \quad (1)$$

$$Z_{0o}'=Z_{0o}/\sin\theta' \quad (2)$$

$$C_e=(1/\omega Z_{0e})/\cos\theta' \quad (3)$$

$$C_o=(1/2\omega Z_{0o})/\cos\theta'-C_e/2 \quad (4)$$

According to the principle explained so far, it can be concluded that the length of a parallel coupled line is inversely proportional to the number of capacitors used. Likewise, it can be concluded that the size of a parallel coupled line filter can be reduced by adding more capacitors to the parallel coupled line filter.

Figure 7:
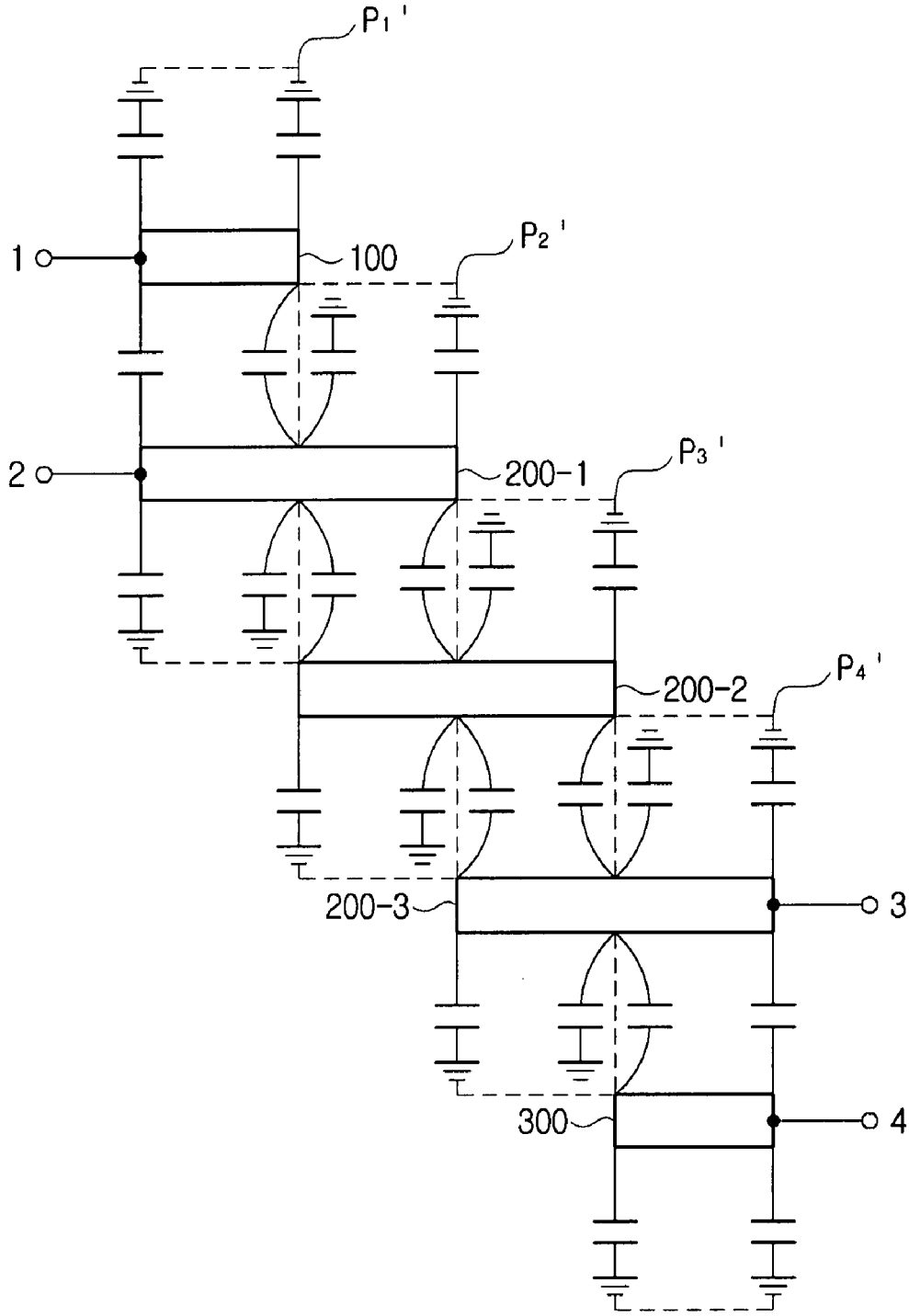
FIG. 7 illustrates a parallel coupled line filter that is miniaturized using capacitors, in accordance with an exemplary embodiment of the present invention.

FIG. 7 illustrates a parallel coupled line filter that is miniaturized using capacitors in accordance with an exemplary embodiment of the present invention. The parallel coupled line filter in FIG. 7 is equivalent to the one in FIG. 4, except that the length of each of the parallel coupled lines $P_1$, $P_2$, $P_3$ and $P_4$ composing the parallel coupled line filter in FIG. 4 is 90° (=λ/4), whereas the length of each of the parallel coupled lines $P_1'$, $P_2'$, $P_3'$ and $P_4'$ composing the parallel coupled line filter in FIG. 7 is 45° (=λ/8). In other words, the parallel coupled line filter in FIG. 7 is half the size of the parallel coupled line filter in FIG. 4.

As can be seen in each of the parallel coupled lines $P_1'$, $P_2'$, $P_3'$ and $P_4'$ in FIG. 7, capacitors are connected to two input ports 1 and 2, respectively, and additional capacitors are connected between the two input ports 1 and 2. In like manner, capacitors are connected to two output ports 3 and 4, respectively, and additional capacitors are connected between the two output ports 3 and 4.

From another viewpoint, in FIG. 4, the lengths of the transmission lines 20-1, 20-2, 20-3 were 180° (=λ/2), and the lengths of the input line 10 and the output line 30 were 90° (=λ/4). On the other hand, in FIG. 7, the lengths of the transmission lines 200-1, 200-2, 200-3 are 90° (=λ/4), and the lengths of the input line 100 and the output line 300 are 45° (=λ/8). Thus, the parallel coupled line filter in FIG. 7 is miniaturized to half the size of the parallel coupled line filter in FIG. 4.

Now looking at each of the transmission lines 200-1, 200-2, 200-3 of the parallel coupled line filter in FIG. 7, two capacitors are connected to each end on both sides, and these capacitors are connected either to ground or another line. Also, there are four capacitors connected to the middle portions. Among them, two capacitors are connected to ground and the other two capacitors are connected to other lines, respectively.

Next, looking at an input line 100, two capacitors are connected to the left end of the input line 100. Among them, one capacitor is connected to ground and the other end is connected to the left end of the transmission line 200-1. Similarly, two capacitors are connected to the right end of the input line 100. Among them, one capacitor is connected to ground and the other end is connected to the middle portion of the transmission line 200-1.

Lastly, looking at an output line 300, two capacitors are connected to the left end of the output line 300. Among them, one capacitor is connected to ground and the other end is connected to the middle portion of the transmission line 200-3. Likewise, two capacitors are connected to the right end of the output line 300. Among them, one capacitor is connected to ground and the other end is connected to the right end of the transmission line 200-3.

It should be noted in FIG. 7 that a total of 24 capacitors are added to miniaturize the parallel coupled line filter. This also conforms to the rule that a total of 6(N+1) capacitors are usually added to an N-th order parallel coupled line filter. That is, since the parallel coupled line filter in FIG. 7 is a $3^{rd}$ order parallel coupled line filter, a total of 24 capacitors are added.

A method for miniaturizing a parallel coupled line filter by reducing the number of capacitors added thereto will now be described. In particular, in order to reduce the total number of capacitors, the ends of the parallel coupled lines (that is, both ends of transmission lines, the right end of an input line, and the left end of an output line) composing the parallel coupled line filter are grounded.

Figure 8A:
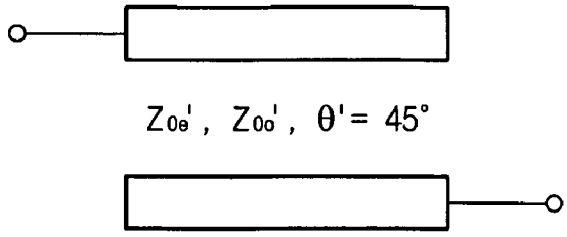
FIG. 8A illustrates a parallel coupled line with an open end.
Figure 8B:
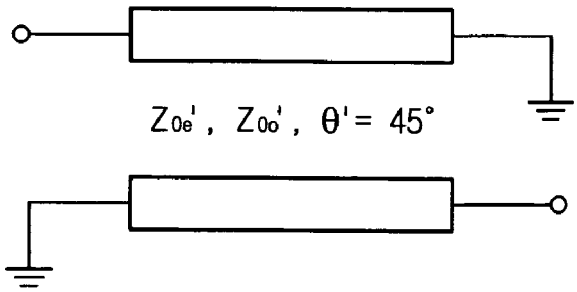
FIG. 8B illustrates a parallel coupled line with a grounded end.

FIG. 8A illustrates a parallel coupled line with an open end, and FIG. 8B illustrates a parallel coupled line with a grounded end. It is assumed that the parallel coupled lines in both FIG. 8A and FIG. 8B have (i) an even-mode characteristic impedance=$Z_{0e}'$, (ii) an odd-mode characteristic impedance=$Z_{0o}'$, and (iii) a length θ'=45° (=λ/8).

Impedance parameters $z_{open.11}$, $z_{open.12}$, $z_{open.21}$, and $z_{open.22}$ of the parallel coupled line with an open end in FIG. 8A satisfy Equations (5) and (6) below. Here, $z_{0e}'$ indicates a normalized even-mode characteristic impedance, and $z_{0o}'$ indicates a normalized odd-mode characteristic impedance.

$$z_{open.11}=z_{open.22}=-(j/2)(z_{0e}'+z_{0o}')\cot\theta' \quad (5)$$

$$z_{open.12}=z_{open.21}=-(j/2)(z_{0e}'-z_{0o}')csc\theta' \quad (6)$$

Further, admittance parameters $y_{short.11}$, $y_{short.12}$, $y_{short.21}$, and $y_{short.22}$ of the parallel coupled line with a grounded end in FIG. 8B satisfy Equations (7) and (8) below.

$$y_{short.11}=y_{short.22}=-(j/2)(1/z_{0o}'+1/z_{0e}')\cot\theta' \quad (7)$$

$$y_{short.12}=y_{short.21}=-(j/2)(1/z_{0o}'-1/z_{0e}')csc\theta' \quad (8)$$

From the relations $Z_{0e}'=1/z_{0o}'$ and $z_{0o}'=1/z_{0e}'$, it can be concluded that $z_{open.11}=z_{open.22}=y_{short.11}=y_{short.22}$, and $z_{open.12}=z_{open.21}=y_{short.12}=y_{short.21}$. In short, an impedance matrix $[Z]_{open}$, of the parallel coupled line with the open end in FIG. 8A is the same with an admittance matrix $[Y]_{short}$ of the parallel coupled line with the grounded end in FIG. 8B, that is, $$[Z]_{open}=[Y]_{short} \quad (9)$$

Based on Equation (9), it is discovered that a scattering coefficient matrix $[S]_{open}$ of the parallel coupled line with the open end in FIG. 8A and a scattering coefficient matrix $[S]_{short}$ with the grounded end in FIG. 8B have a relation as follows:

$$[S]_{open} = [S]_{short}\begin{bmatrix} 1\angle 180^\circ & 0 \\ 0 & 1\angle 180^\circ \end{bmatrix} \quad (10)$$

According to Equation (10), a magnitude of transfer characteristic of the parallel coupled line with the open end is the same with a magnitude of transfer characteristic of the parallel coupled line with the grounded end. That is, although the end of the parallel coupled line may be grounded, the magnitude of transfer characteristic of the parallel coupled line does not change.

Figure 9A:
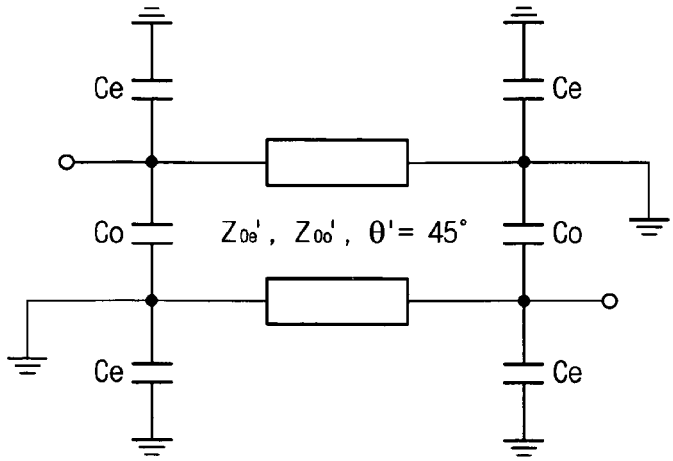
FIG. 9A illustrates a parallel coupled line that is miniaturized using capacitors and has a grounded end.

FIG. 9A illustrates a parallel coupled line that is miniaturized using capacitors and has a grounded end. The parallel coupled line in FIG. 9A is realized by grounding an end of the parallel coupled line in FIG. 6A. Accordingly, the magnitude of transfer characteristic of the parallel coupled line in FIG. 9A is identical with that of the parallel coupled line in FIG. 6A.

In FIG. 9A, when the ends of the parallel coupled line are grounded, $C_e$ of the left lower end and $C_e$ of the right upper end are grounded, becoming dummy capacitors. Then, $C_e$ of the left upper end and $C_o$ of the left middle end are connected in parallel, and $C_o$ of the right middle end and $C_e$ of the right lower end are connected in parallel.

Figure 9B:
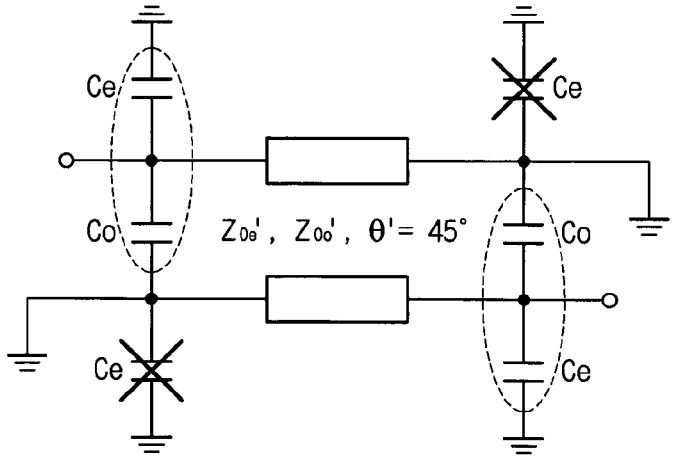
FIG. 9B diagrammatically illustrates how to reduce the number of capacitors connected to a parallel coupled line shown in FIG. 9A.

Accordingly, as shown in FIG. 9B, the dummy capacitors (that is, $C_e$ of the left lower end and $C_e$ of the right upper end) are removed, and the capacitors connected in parallel (that is, $C_e$ of the left upper end and $C_o$ of the left middle end/$C_o$ of the right middle end and $C_e$ of the right lower end) are implemented in one capacitor, respectively, so that the number of capacitors added to the parallel coupled line can be reduced.

Figure 9C:
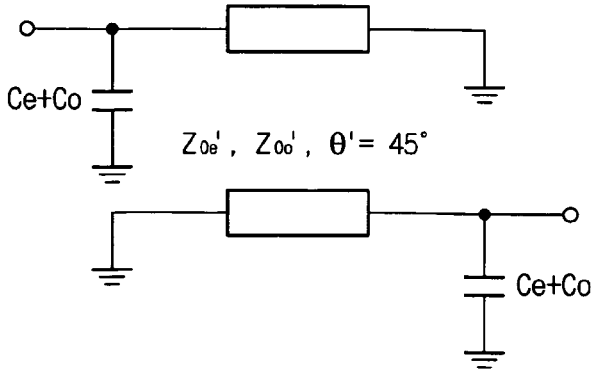
FIG. 9C illustrates a parallel coupled line having a reduced number of capacitors.

The parallel coupled line with a reduced number of capacitors is shown in FIG. 9C. As can be seen in the drawings, although the parallel coupled line in FIG. 9C is equivalent to the parallel coupled line in FIG. 9A, the total number of capacitors used in the parallel coupled line in FIG. 9C is only a third of the total number of capacitors used in the parallel coupled line in FIG. 9A.

Therefore, the method for reducing the number of capacitors by grounding the ends of the parallel coupled line can be applied directly to a parallel coupled line filter. In detail, the number of capacitors required can be reduced markedly by grounding both ends of the transmission lines composing a parallel coupled line filter.

Figure 10A:
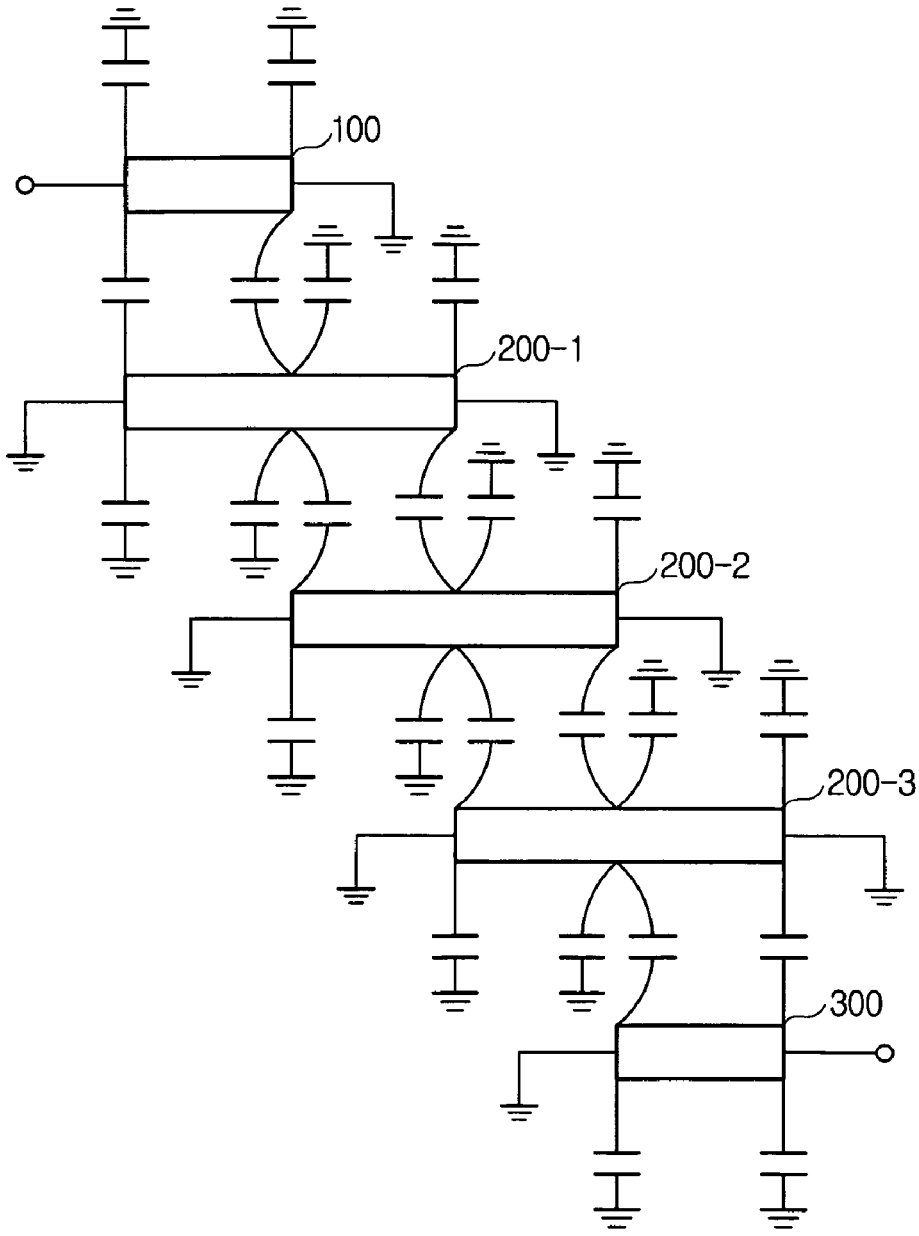
FIG. 10A illustrates a parallel coupled line filter that is miniaturized using capacitors, in which each parallel coupled line has a short end.

FIG. 10A illustrates a parallel coupled line filter that is miniaturized using capacitors, in which each parallel coupled line has a short end (that is, both ends of the transmission lines are grounded). The parallel coupled line filter in FIG. 10A is realized by grounding the ends of the parallel coupled lines (that is, both ends of the transmission lines 200-1, 200-2, 200-3, the right end of the input line 100, and the left end of the output line 300) in the parallel coupled line filter in FIG. 7. Accordingly, the magnitude of transfer characteristic of the parallel coupled line filter in FIG. 10A is identical with that of the parallel coupled line filter in FIG. 7.

Figure 10B:
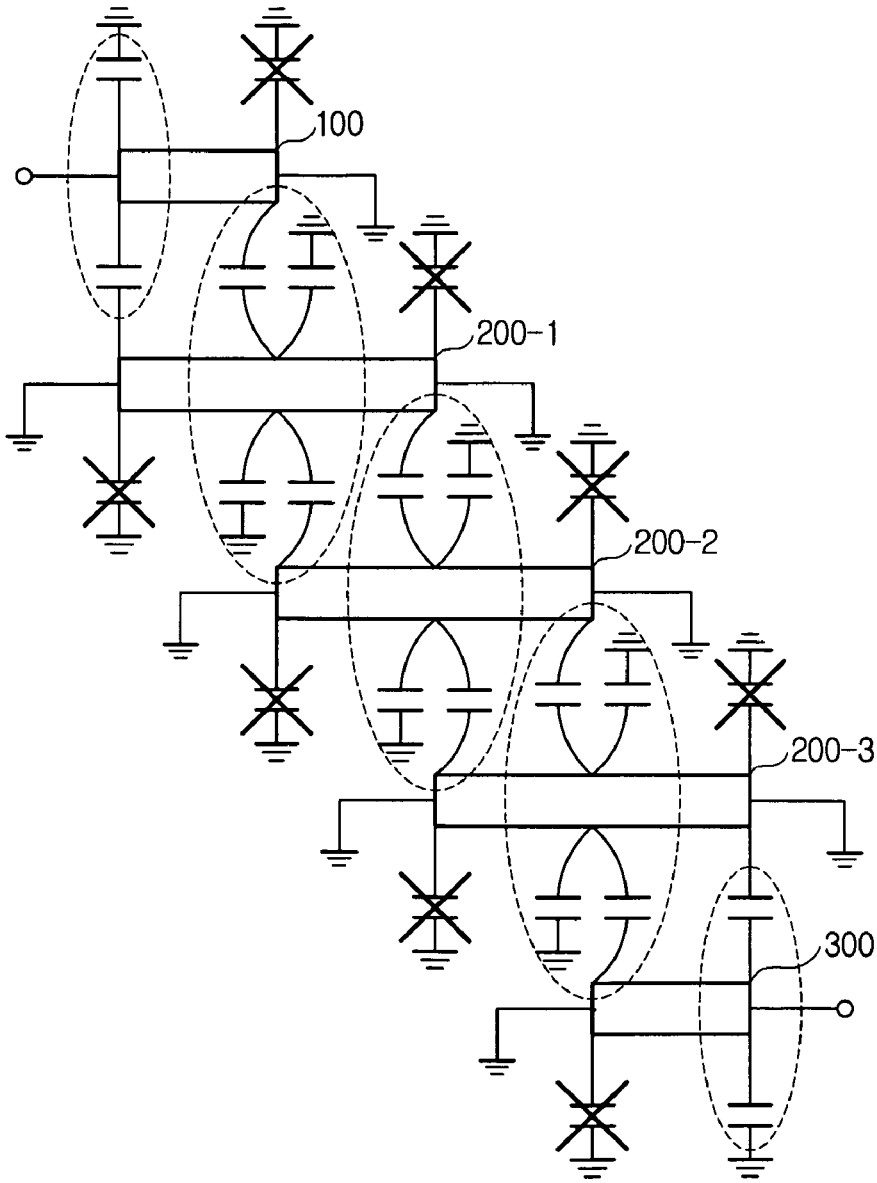
FIG. 10B diagrammatically illustrates how to reduce the number of capacitors connected to a parallel coupled line filter shown in FIG. 10A.

Further, by removing the dummy capacitors from the parallel coupled line filter in FIG. 10A, and implementing the capacitors connected in parallel in one capacitor, respectively, it becomes possible to reduce the total number of capacitors required. This procedure is diagrammatically shown in FIG. 10B.

Figure 10C:
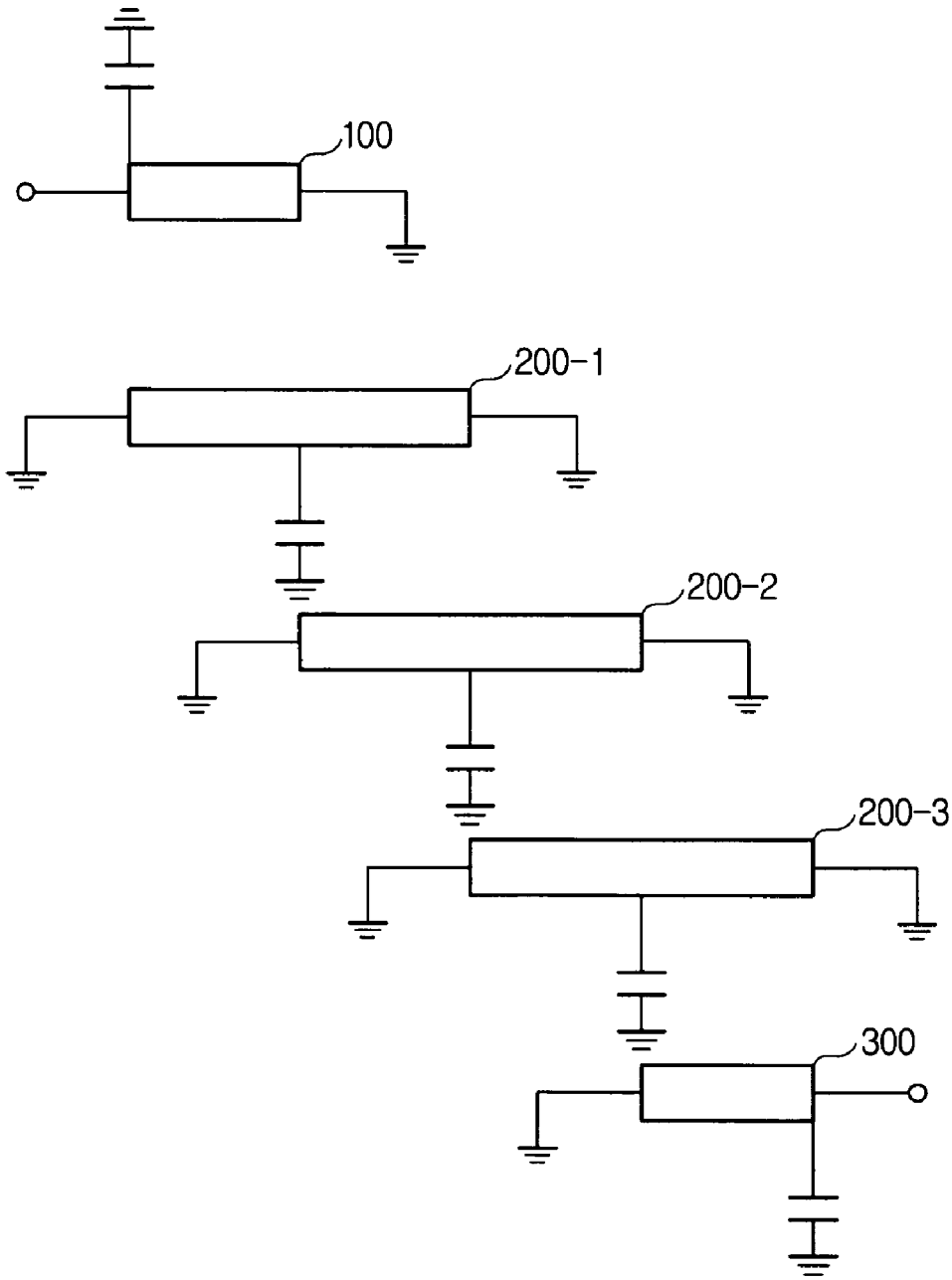
FIG. 10C illustrates a parallel coupled line filter having a reduced number of capacitors.

FIG. 10C illustrates the parallel coupled line filter with a reduced number of capacitors. As can be seen in the drawings, although the parallel coupled line filter in FIG. 10C is equivalent to the parallel coupled line filter in FIG. 7, the total number of capacitors used in the parallel coupled line filter in FIG. 10C is 19 less than the total number of capacitors used in the parallel coupled line filter in FIG. 7.

Referring to FIG. 10C, the lines 100, 200-1, 200-2, 200-3, 300 composing the parallel coupled line filter are connected to one capacitor, respectively. As such, a total of (N+2) of capacitors are required for an N-th order parallel coupled line filter. For instance, the $3^{rd}$ order parallel coupled line filter shown in FIG. 10C requires 5 capacitors in total.

Figure 11:
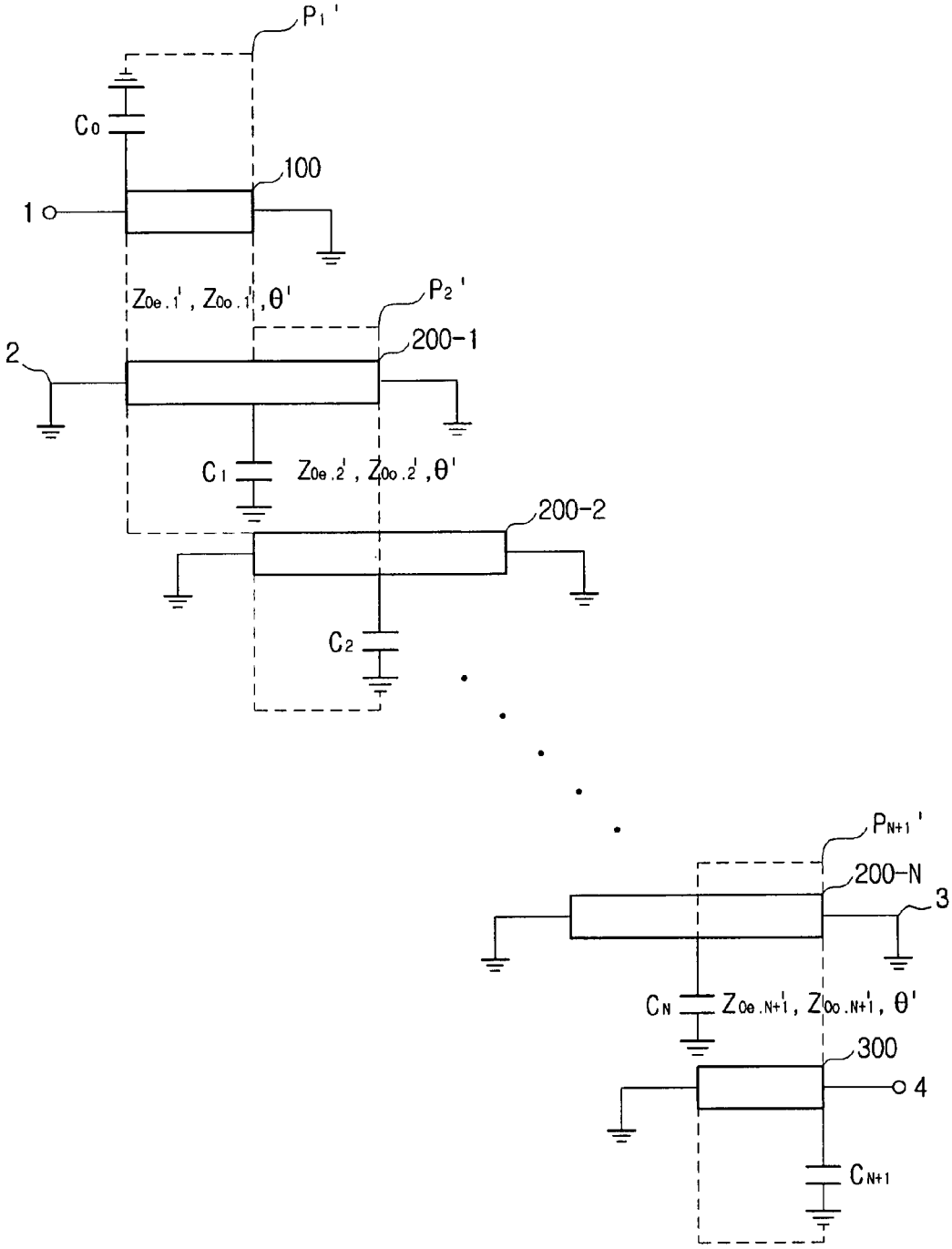
FIG. 11 illustrates an N-th order parallel coupled line filter that is miniaturized using capacitors and has a reduced number of capacitors by grounding, in accordance with another exemplary embodiment of the present invention.

FIG. 11 illustrates an N-th order parallel coupled line filter that is miniaturized using capacitors and has a reduced number of capacitors by grounding, in accordance with another exemplary embodiment of the present invention.

The N-th order parallel coupled line filter includes (N+1) parallel coupled lines, each being θ' in length, and (N+2) capacitors $C_0, C_1, C_2, \ldots, C_N, C_{N+1}$. Further, ends of the parallel coupled lines are grounded.

For each of the parallel coupled lines $P_1', P_2', \ldots, P_{N+1}'$, capacitors provided to an upper input port 1 and a lower output port 4 are connected in parallel, respectively, and ports 2 and 3 provided to a lower input end and an upper output port, respectively, are grounded.

An even-mode characteristic impedance $Z_{0e.n}'$ and an odd-mode characteristic impedance $Z_{0o.n}'$ of an n-th order (n=1, 2, . . . , N+1) parallel coupled line $P_n'$ satisfy the following Equations (11) and (12).

$$Z_{0e.n}'=Z_{Oe.n}/\sin\theta', n=1, 2, \ldots, N+1 \quad (11)$$

$$Z_{0o.n}'=Z_{0o.n}/\sin\theta', n=1, 2, \ldots, N+1 \quad (12)$$

Also, the capacitances of the capacitors ($C_0, C_1, C_2, \ldots, C_N, C_{N+1}$) connected in parallel to the input ends and the output ends of the parallel coupled lines satisfy the following Equations (13) to (15).

$$C_0=(1/2\omega)(1/Z_{0e.1}+1/Z_{0o.1})\cos\theta' \quad (13)$$

$$C_n=(1/2\omega)(1/Z_{0e.n}+1/Z_{0o.n}+1/Z_{0e.n+1}+1/Z_{0o.n+1})\cos\theta'$$

$$n=1, 2, \ldots, N \quad (14)$$

$$C_{N+1}=(1/2\omega)(1/Z_{0e.N+1}+1/Z_{0o.N+1})\cos\theta' \quad (15)$$

From a different viewpoint, the N-th order parallel coupled line filter in FIG. 11 includes an input line 100 on the top end, being θ' in length, an output line 300 on the bottom end, being θ' in length, and N transmission lines 200-1, 200-2, . . . , 200-N between the input line 100 and the output line 300, each being 2θ' in length.

Now looking at the individual transmission line 200-1, 200-2, . . . , 200-N composing the parallel coupled line filter in FIG. 11, the left end and the right end are grounded, and the middle portion is connected to one capacitor. Here, the capacitor is also connected to ground.

In case of the input line 100, its left end is connected to one capacitor, whereas its right end is grounded. In case of the output line 300, its left end is grounded, whereas its right end is connected to one capacitor.

So far, it has been explained how the parallel coupled line filter is miniaturized using the lumped capacitors and grounding. A fabrication method of the parallel coupled line filter of the invention will be explained with reference to FIG. 12. In particular, FIG. 12 is a flow chart explaining a fabrication method of an N-th order parallel coupled line filter.

Figure 12:
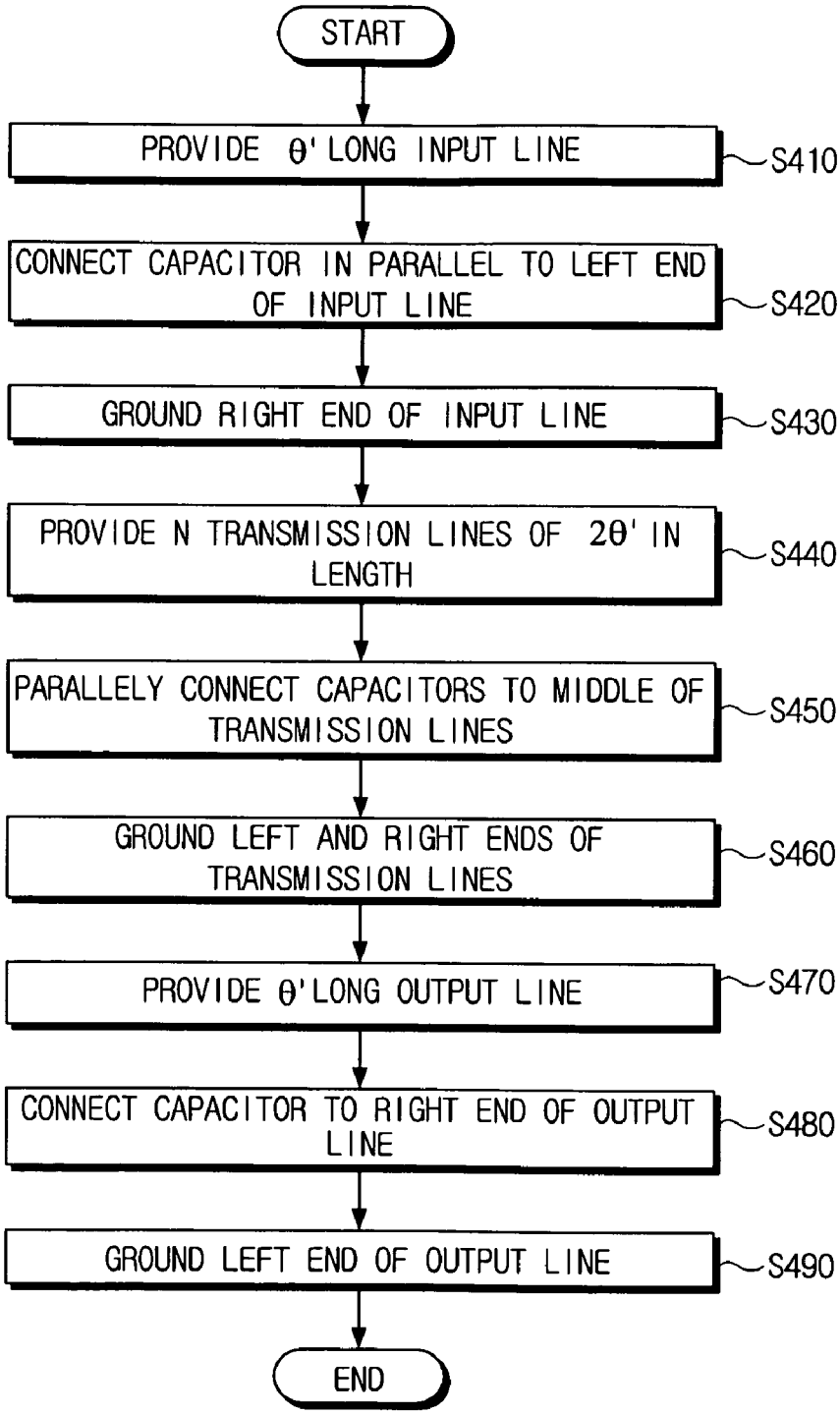
FIG. 12 is a flow chart explaining a fabrication method of an N-th order parallel coupled line filter shown in FIG. 11.

Referring to FIG. 12, an input line 100 having a length θ' is provided (S410). Next, a capacitor $C_0$ is connected in parallel to the left end of the input line 100 (S420). The capacitance of the capacitor $C_0$ can be obtained from Equation (13). The right end of the input line 100 is grounded (S430).

Below the input line 100 is N transmission lines 200-1, 200-2, . . . , 200-N, each being 2θ' in length (S440). And the capacitors $C_1$, $C_2$, . . . , $C_N$ are connected in parallel to the middle portions of the transmission lines 200-1, 200-2, . . . , 200-N, respectively (S450). Here, the capacitances of the capacitors $C_1$, $C_2$, . . . , $C_N$ satisfy the equation (14). The left end and the end of the individual transmission line 200-1, 200-2, . . . , 200-N are grounded (S460).

Below the N-th transmission line 200-N is an output line 300 having a length θ' (S470). Then, a capacitor $C_{N+1}$ is parallely connected to the right end of the output line 300 (S480). The capacitance of the capacitor $C_{N+1}$ can be obtained from Equation (15). Lastly, the left end of the output line 300 is grounded (S490).

Figure 13:
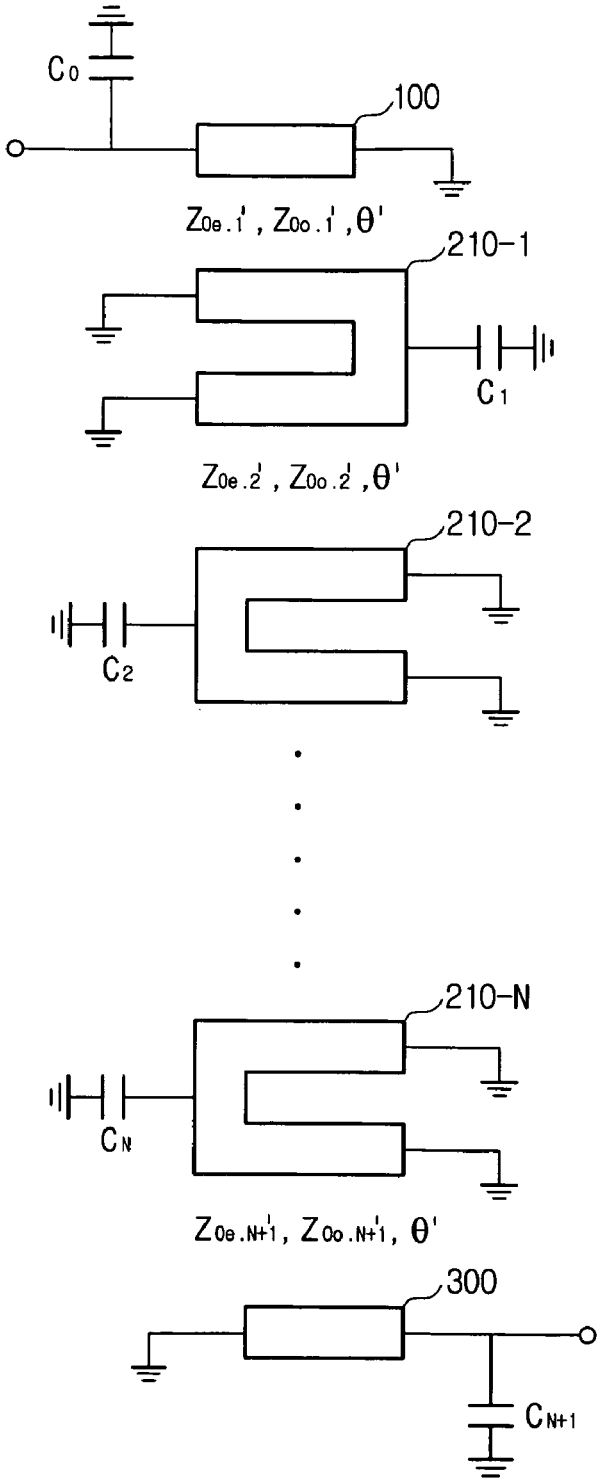
FIG. 13 illustrates an N-th order parallel coupled line filter using transmission lines that are bent into a hairpin shape, in accordance with still another exemplary embodiment of the present invention.

FIG. 13 illustrates an N-th order parallel coupled line filter using transmission lines that are bent into a hairpin shape, in accordance with still another exemplary embodiment of the present invention. As can be seen in FIG. 13, by using transmission lines 210-1, 210-2, 210-3 that are bent into a hairpin shape, the width of the N-th order parallel coupled filter is reduced, compared with the width of the N-th order parallel coupled filter using linearly straight transmission lines.

The following will now describe a computer simulation result for performance verification of a parallel coupled line filter according to one embodiment of the present invention.

For performance verification, five Chebyshev $3^{rd}$ order parallel coupled line filters are designed utilizing a computer simulation program Advanced Design System 2002 (ADS 2002). Here, the Chebyshev filter is designed to have a 900 MHz of center frequency (which corresponds to a frequency band for cellular phones), 10% of FBW, and 0.5 dB of passband ripple.

Among the five Chebyshev filters, two are not miniaturized filters, in which one of them has an open end for each parallel coupled line and the other has a grounded end for each parallel coupled line. The length θ of the individual parallel coupled line of the filters is 90° (=λ/4). Table 1 shows even-mode characteristic impedances $Z_{0e.n}$ and odd-mode characteristic impedances $Z_{0o.n}$ of parallel coupled lines.

TABLE 1

| | θ = 90° (=λ/4). | |
|---|---|---|
| n | $Z_{0e\cdot n}$ [Ω] | $Z_{0o\cdot n}$ [Ω] |
| 1 | 70.61 | 39.24 |
| 2 | 56.64 | 44.77 |
| 3 | 56.64 | 44.77 |
| 4 | 70.61 | 39.24 |

The other three filters are miniaturized filters according to the present invention. The filters are designed to be 45° (=λ/8) in length (i.e., θ'=45° (=λ/8)), 22.5° (=λ/16), and 11.25° (=λ/32), respectively. Table 2 shows even-mode characteristic impedances $Z_{0e.n}$ and odd-mode characteristic impedances $Z_{0o.n}$ of parallel coupled lines, and capacitances of capacitors $C_e$, $C_o$, and $C_n$ for the individual miniaturized filter.

TABLE 2

| n | $Z_{0e\cdot n}'$[Ω] | $Z_{0o\cdot n}'$[Ω] | $C_e$ [pF] | $C_o$ [pF] | $C_n$ [pF] |
|---|---|---|---|---|---|
| | | θ' = 45° (=λ/8) | | | |
| 0 | — | — | — | — | 2.489 |
| 1 | 99.86 | 55.49 | 1.771 | 0.708 | 4.989 |
| 2 | 80.11 | 63.31 | 2.208 | 0.297 | 5.000 |
| 3 | 80.11 | 63.31 | 2.208 | 0.297 | 4.989 |
| 4 | 99.86 | 55.49 | 1.771 | 0.708 | 2.489 |

TABLE 2-continued

| n | $Z_{0e\cdot n}'$[Ω] | $Z_{0o\cdot n}'$[Ω] | $C_e$ [pF] | $C_o$ [pF] | $C_n$ [pF] |
|---|---|---|---|---|---|
| | | θ' = 22.5° (=λ/16) | | | |
| 0 | — | — | — | — | 3.239 |
| 1 | 184.51 | 102.54 | 2.314 | 0.925 | 6.506 |
| 2 | 148.01 | 116.99 | 2.885 | 0.382 | 6.534 |
| 3 | 148.01 | 116.99 | 2.885 | 0.382 | 6.506 |
| 4 | 184.51 | 102.54 | 2.314 | 0.925 | 3.239 |
| | | θ' = 11.25° (=λ/32) | | | |
| 0 | — | — | — | — | 3.438 |
| 1 | 361.93 | 201.14 | 2.456 | 0.982 | 6.906 |
| 2 | 290.33 | 229.48 | 3.062 | 0.406 | 6.936 |
| 3 | 290.33 | 229.48 | 3.062 | 0.406 | 6.906 |
| 4 | 361.93 | 201.14 | 2.456 | 0.982 | 3.438 |

Figure 14:
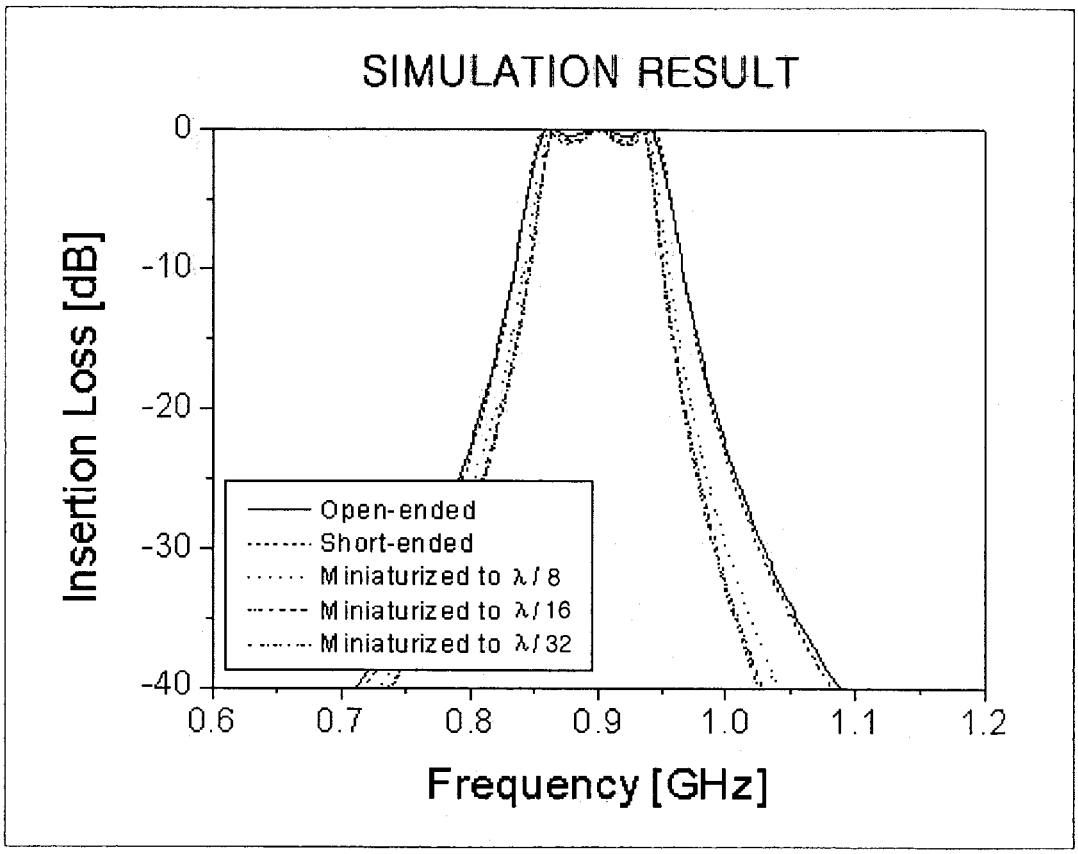
FIG. 14 illustrates a computer simulation result of an N-th order parallel coupled line filter.

FIG. 14 illustrates computer simulation results of five Chebyshev filters. According to the computer simulation results, despite the smaller size, miniaturized filters exhibited equivalent center frequencies and band-pass characteristics to those of non-miniaturized (full-size) filters.

Figure 15A:
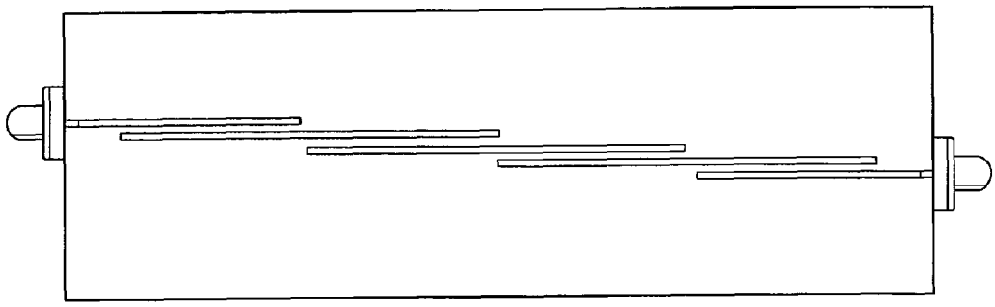
FIGS. 15A to 15C illustrate picture images of N-th order parallel coupled line filters that are fabricated according to exemplary embodiments of the present invention.
Figure 15B:
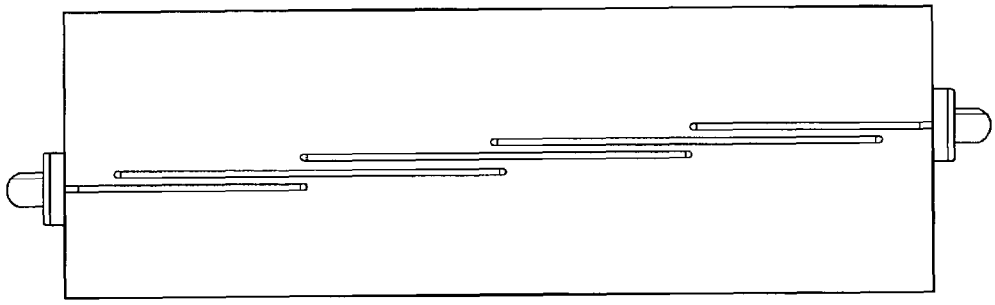
Figure 15C:
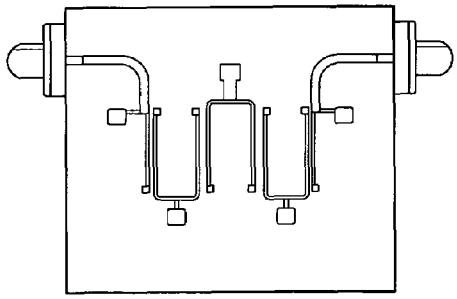

For more substantial performance verification of the parallel coupled line filters of the present invention, filtering characteristics of the filters were measured. FIGS. 15A to 15C illustrate pictures of three parallel coupled line filters that were actually fabricated for measurement.

FIG. 15(A) illustrates a non-miniaturized filter with an open end; FIG. 15(B) illustrates a non-miniaturized filter with a short end; and FIG. 15(C) illustrates a miniaturized filter of the present invention, using transmission lines bent in hairpin shape.

The filters shown in FIGS. 15(A) to 15(C) are fabricated on a Duroid substrate ($\epsilon_r$=10). Also, the parallel coupled lines of the filters shown in FIG. 15(A) and FIG. 15(B) are designed to be 90° (=λ/4) in length, and have even-mode characteristic impedances $Z_{0e.n}$ and odd-mode characteristic impedances $Z_{0o.n}$ shown in Table 1. On the other hand, the parallel coupled lines of the filters shown in FIG. 15(C) are designed to be 45° (=λ/8) in length, and have even-mode characteristic impedances $Z_{0e.n'}$ and odd-mode characteristic impedances $Z_{0o.n'}$ of the parallel coupled lines, and capacitances of capacitors $C_e$, $C_o$, and $C_n$ shown in Table 2, except that the 2.489 pF capacitor was replaced by a 2.5 pF capacitor, and the 4.989 pF capacitor was replaced by a 5.0 pF capacitor, respectively.

According to the measurement result, the surface area of the full-size filter was 15×5 $cm^2$, whereas the surface area of the miniaturized filter was 5×4.5 $cm^2$. That is, the width and the surface area of the miniaturized filter were only a third of the width and the surface area of the full-size filter.

Figure 16A:
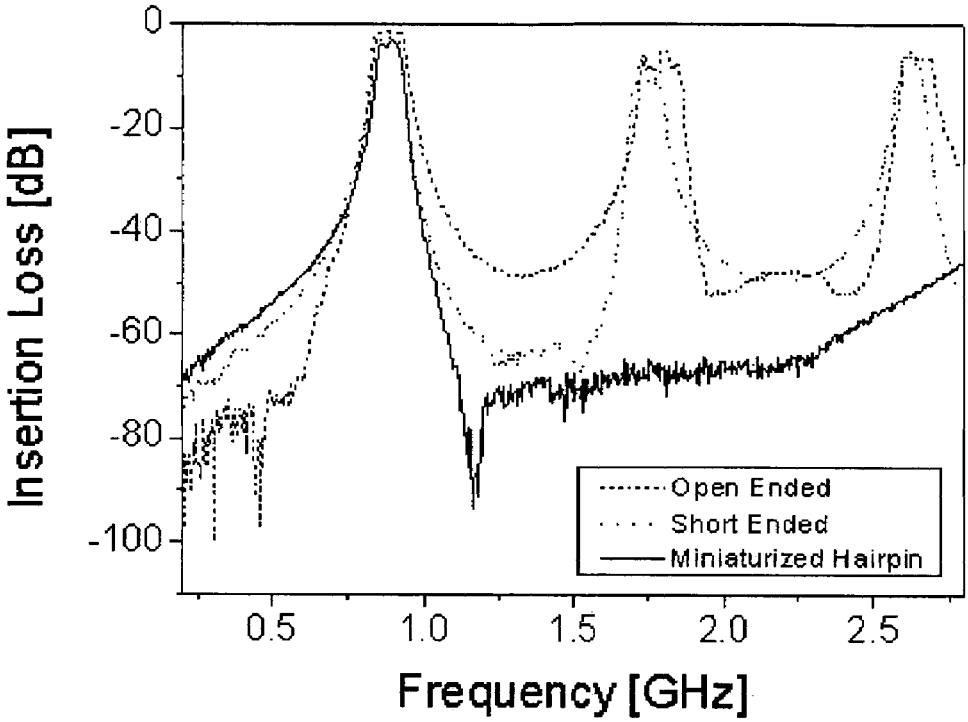
FIGS. 16A to 16B illustrate results of measurement in filtering characteristics of N-th order parallel coupled line filters shown in FIG. 15.
Figure 16B:
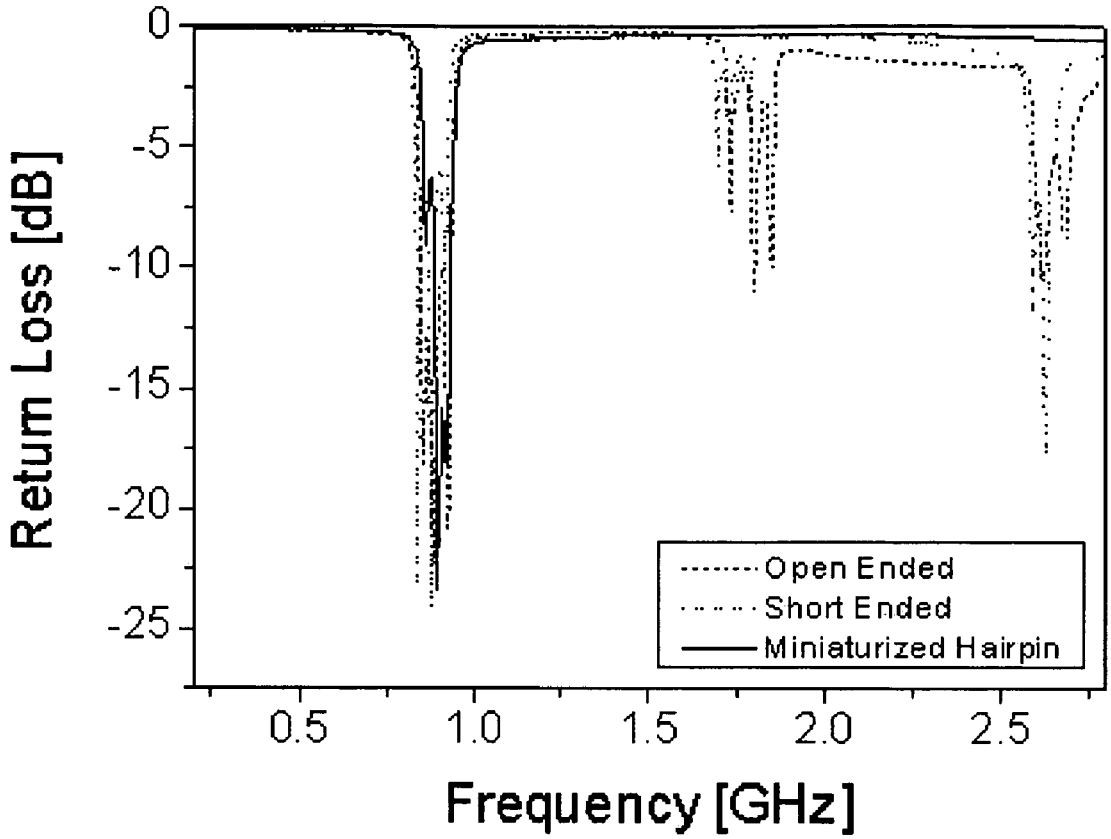
Figure 17A:
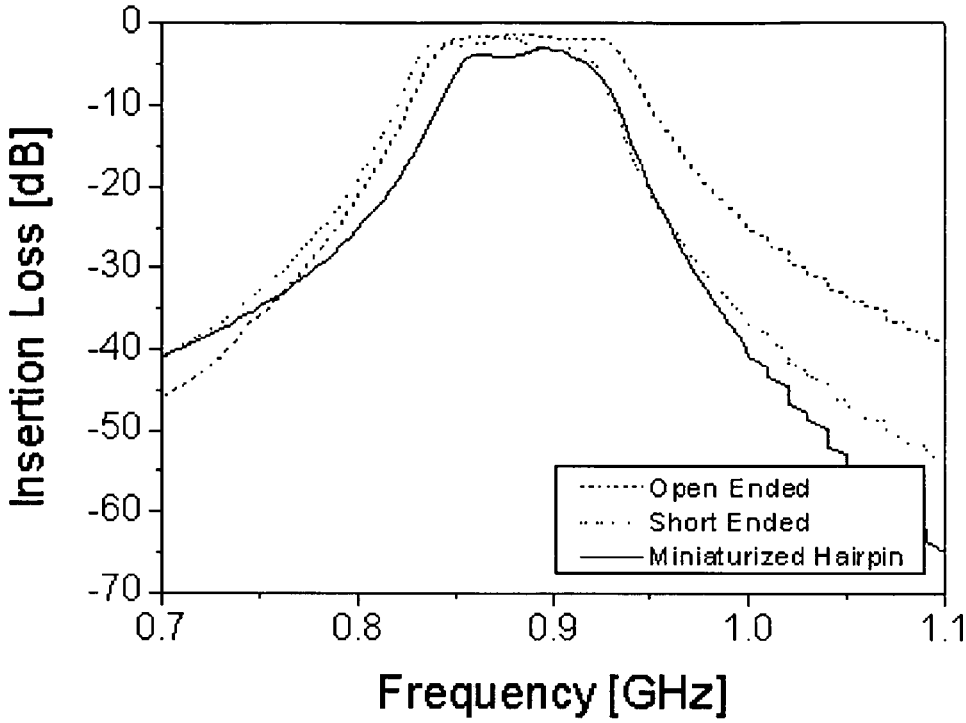
FIGS. 17A and 17B illustrate exploded views of measurement results around 900 MHz.
Figure 17B:
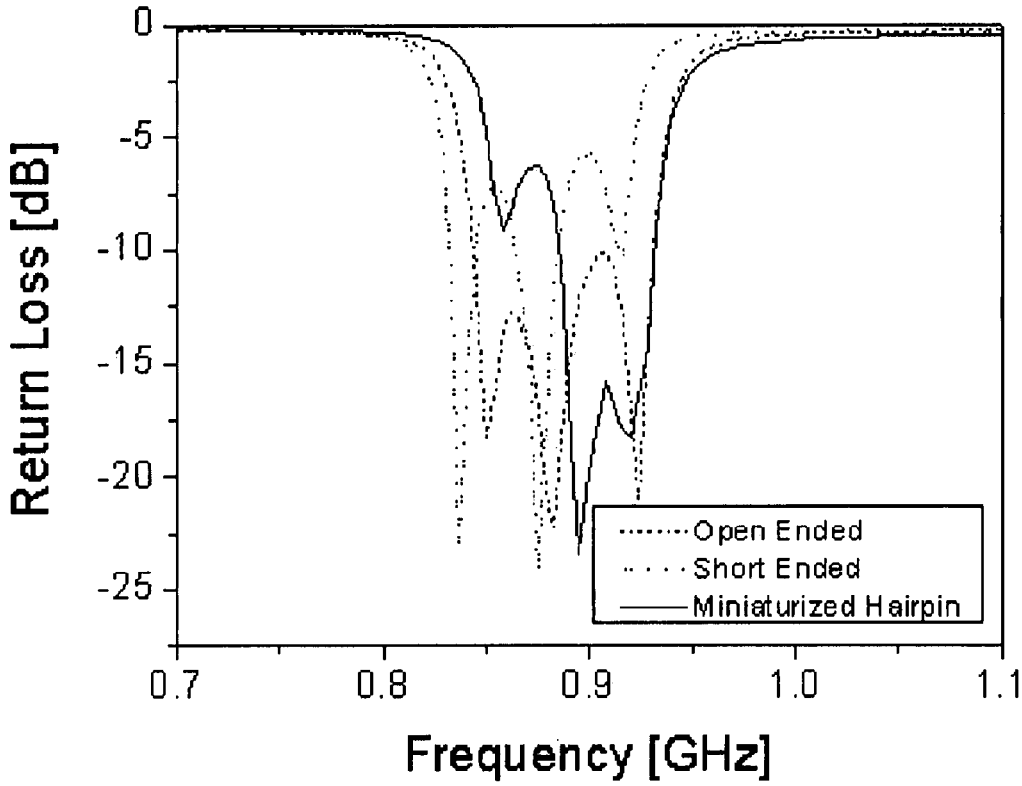

Filtering characteristics of the three fabricated filters were measured using a Vector Network Analyzer (VNA). The results are shown in FIGS. 16A, 16B, 17A and 17B. In particular, FIGS. 17A and 17B illustrate exploded views of measurement results around 900 MHz.

According to the measurement results, the miniaturized filter exhibited superior frequency selectivity to the other full-size filters.

Referring back to FIGS. 16A and 16B, the miniaturizing filter generated much less harmonics than the non-miniaturized filters. Furthermore, as can be seen in FIGS. 16A and 16B, the generation of secondary and tertiary harmonics by the miniaturized filter was successfully controlled.

In summary, the miniaturized filter, compared with the non-miniaturized filters, exhibited much improved harmonic characteristics and sharp skirt characteristics on the high frequency side. Especially, the use of lumped capacitors improved harmonic characteristics of the miniaturized filter.

As explained before, it is possible to miniaturize the parallel coupled line filter to desirable size using lumped capacitors and grounding. Since the miniaturization scheme of the present invention is based on the relatively simple theoretical knowledge, the overall design process can be done very easily.

Moreover, the miniaturized parallel coupled line filter of the present invention exhibits superior frequency selectivity, improved harmonic characteristics, and sharp skirt characteristics on the high frequency side.

The foregoing exemplary embodiments and advantages are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. A parallel coupled line filter comprising:

a parallel coupled line including first and second input ports and first and second output ports;

a first capacitor connected to the first input port of the parallel coupled line;

a second capacitor connected to the first output port of the parallel coupled line;

a third capacitor connected between the first and second input ports of the parallel coupled line; and a fourth capacitor connected between the first and second output ports of the parallel coupled line.

2. The filter according to claim 1, wherein at least one of the second input port and the second output port is grounded.

3. The filter according to claim 1 further comprising:

a fifth capacitor connected to the second input port; and a sixth capacitor connected to the second output port.

4. The filter according to claim 1, wherein the parallel coupled line has a length shorter than $\lambda/4$; and capacitances of the first and second capacitors are each determined based on the length.

5. The filter according to claim 4, wherein an even-mode characteristic impedance and an odd-mode characteristic impedance of the parallel coupled line are each determined based on the length.

6. A fabrication method of a parallel coupled line filter, the method comprising:

providing a parallel coupled line including first and second input ports and first and second output ports;

connecting a first capacitor to the first input port of the parallel coupled line;

connecting a second capacitor to the first output port of the parallel coupled line;

connecting a third capacitor between the first and second input ports of the parallel coupled line; and connecting a fourth capacitor between the first and second output ports of the parallel coupled line.

7. The method according to claim 6 further comprising grounding at least one of the second input port and the second output port.

8. The method according to claim 6 further comprising:

connecting a fifth capacitor to the second input port; and connecting a sixth capacitor to the second output port.

9. The method according to claim 6, wherein the parallel coupled line has a length shorter than $\lambda/4$; and capacitances of the first and second capacitors are each determined based on the length.

10. The method according to claim 9, wherein an even-mode characteristic impedance and an odd-mode characteristic impedance of the parallel coupled line are each determined based on the length.

11. The filter according to claim 1, further comprising:

an input line including the first input port;

an output line including the first output port; and a transmission line coupled in parallel therebetween to at least one of the input line and the output line, wherein the lengths of the input line and the output line are 45°, the length of the transmission line is 90°, and the length of the parallel coupled line is 45°.

12. The method according to claim 6, further comprising:

providing an input line including the first input port, an output line including the first output port, and a transmission line coupled in parallel therebetween to at least one of the input line and the output line, wherein the lengths of the input line and the output line are 45°, the length of the transmission line is 90°, and the length of the parallel coupled line is 45°.

* * * * *